United States Patent [19]

Archenholtz

[11] 4,415,362

[45] Nov. 15, 1983

[54] NODULAR IRON MAKING AND/OR STORING

[75] Inventor: Åke Archenholtz, Västerås, Sweden

[73] Assignee: ASEA AB, Västerås, Sweden

[21] Appl. No.: 448,348

[22] Filed: Dec. 9, 1982

[30] Foreign Application Priority Data

Dec. 15, 1981 [SE] Sweden ..... 8107489

[51] Int. Cl.[3] ..... C22C 33/08

[52] U.S. Cl. ..... 75/130 B; 75/53; 266/81; 266/89; 266/216; 266/223

[58] Field of Search ..... 75/130 R, 53; 266/81, 266/89, 216, 223

[56] References Cited

U.S. PATENT DOCUMENTS 3,295,960 1/1967 Parlee ..... 75/130 R 3,764,305 10/1973 Andersson ..... 75/130 R

*Primary Examiner*—Peter D. Rosenberg

*Attorney, Agent, or Firm*—Kenyon & Kenyon

[57] ABSTRACT

A melt of magnesium-containing nodular iron partially fills an enclosure forming a space above the melt which fills with the vapor of magnesium evaporated from the melt. Magnesium is fed into the space where the magnesium vaporizes and increases the vapor pressure so as to drive magnesium into the melt and increase its magnesium content.

3 Claims, 2 Drawing Figures

NODULAR IRON MAKING AND/OR STORING

Figure 1:
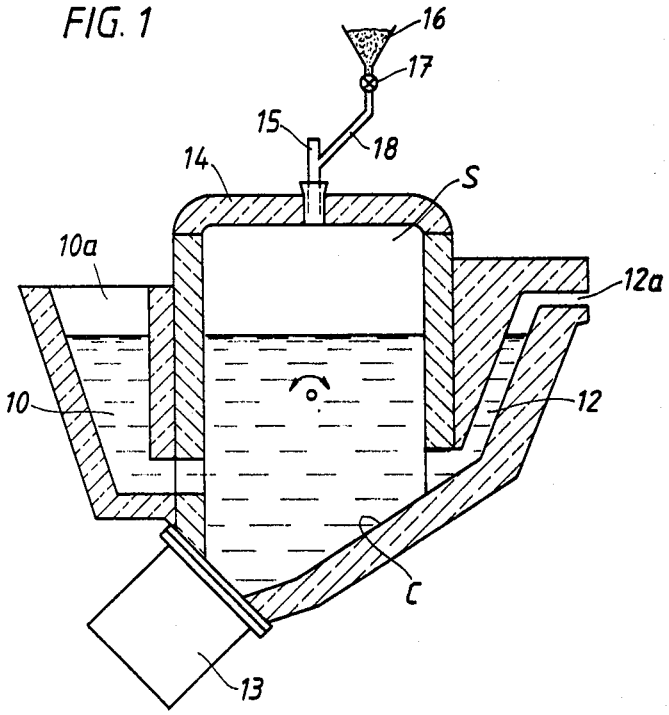

Nodular iron can be made by treating a melt of cast iron with magnesium. For casting the iron must have a temperature substantially higher than the boiling point temperature of the magnesium and the latter is, therefore, continuously lost by evaporation from the melt in the form of magnesium vapor. The loss can be kept to a tolerable value by casting the melt promptly.

To permit the melt to be cast slowly or incrementally, it must be stored without excessive magnesium loss, and for this purpose U.S. Pat. No. 3,764,305 discloses a furnace having a crucible provided with a gas-tight lid so as to form an enclosure adapted to be partially filled by the melt and confine a space above the melt level. This pace can be evacuated and filled with a gas non-reactive to magnesium, the space confining the magnesium vapor evaporating from the melt and preventing further magnesium loss from the melt when the partial pressure of the vapor in the space reaches equilibrium with the liquid magnesium in the melt.

To maintain the melt temperature, the furnace crucible has a channel-type inductor in its bottom, and to permit charging and tapping without opening the space to the ambient air, the crucible has a melt inlet conduit extending from a charging opening above the melt level in the crucible downwardly and through one side of the crucible adjacent to its bottom, and a melt outlet conduit opening from the opposite side of the crucible adjacent to the crucible's bottom and extending upwardly to a tapping opening above the melt level. The melt fills both the inlet and outlet conduits up to or a little above the melt level in the crucible, isolating the melt from the ambient air. The inlet and outlet openings are of relatively small cross-sectional area and result in only minimal magnesium loss where they expose the melt to the ambient air. For tapping the furnace is rocked towards the outlet without emptying the inlet conduit, and because of this and its general shape, the furnace is called a teapot-type channel inductor furnace.

This teapot type furnace permits a nodular iron melt containing magnesium to be poured or tapped from its source such as a melting furnace or ladle where the magnesium is normally added, into the teapot's charging opening so as to partially fill the furnace's crucible and form the space above the melt level and below the gas-tight lid, the space being then evacuated and filled with gas such as nitrogen, argon or other protective gas. When the magnesium vapor from the melt and confined in the space above the melt, develops its critical pressure, the magnesium loss from the melt terminates, and with the melt stirred and heated by the channel-type inductor, it can be stored for a relatively long time, but with its magnesium content reduced by loss of the magnesium existing in vapor phase above the melt.

As the melt is partially used, the space above the melt level increases in volume, requiring further magnesium loss from the remaining melt to maintain the partial pressure of the magnesium vapor at its critical point or equilibrium pressure where the melt's liquid magnesium no longer evaporates.

The present invention can prevent the above magnesium loss from the stored melt, and in addition permit an increase in the melt's magnesium content if desired. This is effected as follows:

The melt in the teapot-type furnace is maintained by the channel-type inductor at casting temperature which inherently is substantially above the boiling point temperature of liquid magnesium. The melt radiates this heat into the space confined above the melt, so the space temperature is also above that boiling point temperature. The space may contain magnesium in its vapor phase and must contain the protective gas.

According to the invention, the fluid pressure in this space is measured continuously or at intervals, and in response to this measuring magnesium or magnesium-containing particles are fed into the space continuously or intermittently without loss of pressure from the space, until the measuring shows that a predetermined pressure is attained and/or maintained in the space. This pressure is caused by the particles substantially immediately converting to vapor in the space so as to increase the partial pressure of the magnesium vapor in the space, consequently driving magnesium into the melt until the liquid magnesium in the melt and the magnesium vapor are in equilibrium. The value of the predetermined pressure, therefore, depends on the magnesium content desired in the melt. The initial magnesium content of the melt stored can be retained or increased if desired. The continuous stirring of the melt effected by the channel-type inductor, continuously maintains the melt's composition substantially uniform throughout, as well as supplying heat to the melt as required. By keeping the melt-temperature at a constant value, the space pressure measuring is more precisely a determination of the partial pressure of the magnesium vapor in the space, permitting more accurate control of the liquid magnesium content of the melt.

If the melt charged in the teapot-type furnace is plain cast iron, magnesium can be added to the melt so as to make nodular iron, or if the charge is nodular iron of too low a magnesium content, this content can be increased to that required.

To practice the invention, the patented teapot-type furnace has been modified as shown by the accompanying drawings in which:

FIG. 1 schematically shows in vertical section the teapot-type furnace; and

Figure 2:
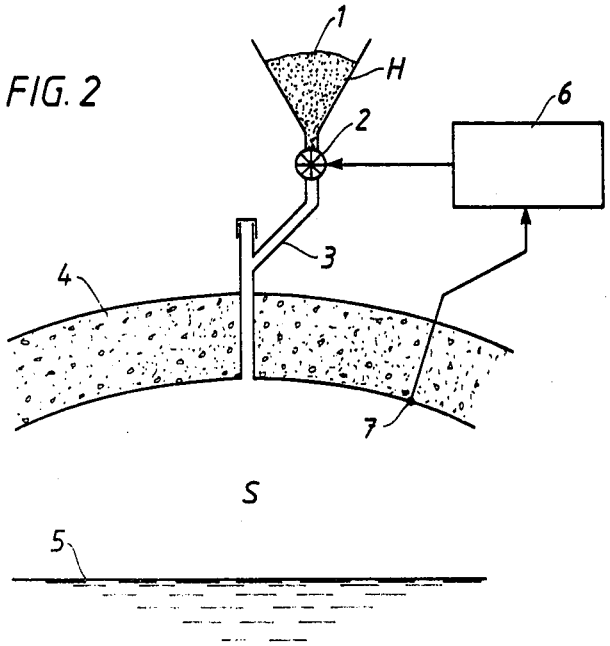

FIG. 2 schematically in vertical section on a larger scale shows the details of the modification.

Referring first to FIG. 2, a hopper H containing the magnesium or magnesium-containing particles 1 supplies a rotary vane-type feeder 2 of the controllable, variable rotation type, which through a pipe 3 feeds through the top of the gas-tight lid 4 of the furnace and into the space S above the melt 5. This space is filled with a protective gas, such as argon, nitrogen, etc., and when the melt 5 is nodular iron containing magnesium, magnesium vapors rise and fill the space S which is heated by radiation from the melt 5 to above the boiling point temperature of magnesium.

The rotary vane feeder 2 is intermittently or continuously rotated, normally by means of an electric motor (not shown), under the control of a transducer 6 actuated by a pressure-measuring element 7 in the space S. The pressure in the space S is partially due to the protective gas and partially to the magnesium vapor which is evaportated from the melt 5. Without operation of the feeder 2 the partial pressure of the magnesium vapor in the space S inherently increases until it reaches the critical point of equilibrium with the liquid magnesium in the melt 5, at which time there is no further magnesium evaporation from the melt 5. There is a corresponding loss of liquid magnesium in the melt. The transducer 6 may be of the type which responds automatically to a signal from the pressure-measuring element 7, and it is set or adjusted so as to activate the vane-type feeder 2 as required to automatically maintain the pressure in the space S at a predetermined value which is fixed by the desired magnesium content of the melt 5. If the partial pressure of the magnesium vapor in the space S is lower than is required to provide equilibrium between the vapor and the liquid magnesium of desired content in the melt 5, the pressure-measuring unit 7 sends a signal to the transducer 6 which automatically activates the vane-type feeder 2 so that the magnesium-containing particles 1 are fed through the top of the furnace's lid 4.

As the particles enter the space S, they are substantially instantaneously vaporized because the space S is inherently heated by radiaton from the melt 5 to a temperature substantially above the boiling point temperature of magnesium. The resulting increase in magnesium vapor in the space S results in magnesium being driven down into the melt 5 until equilibrium is reached which, when detected by the element 7 and via the transducer 6, automatically stops further feeding. The pressure in the space S is dependent on the desired magnesium content in the melt 5.

The details of the furnace are illustrated by FIG. 5 where the crucible is indicated at C with its melt inlet conduit 10 extending from its charging opening 10*a* above the melt level in the crucible, downwardly and through one side of the crucible adjacent to the crucible's bottom. Also shown is the melt outlet conduit 12 opening from the opposite side of the crucible adjacent to the crucible's bottom and extending upwardly to a tapping opening or spout 12*a* above the melt level. The melt fills both the inlet and outlet conduits up to or a little above the melt level in the crucible, isolating the melt from the ambient air. The height of the melt in the conduits depends on the pressure in the space S. Both the inlet and outlet openings are each of samll cross-sectional area and cannot result in any substantial magnesium vapor loss where they expose the melt to the ambient air. For tapping, the furnace is titled or rocked towards the outlet while retaining enough melt in the inlet conduit to prevent opening of the space S to the ambient air.

The bottom of the crucible C slopes towards the two mouths or openings (unillustrated) of the channel-type inductor 13 which is fixed to the sloping bottom of the crucible C at its lowest point. This may be a conventional channel-type inductor and by its use the melt 5 can be maintained at an appropriate casting temperature or its temperature increased if desired, while all the while the melt is stirred in the characteristic fashion resulting from operation of a channel-type inductor. This stirring causes all of the melt at some time to reach the melt's surface and exposure to the space S. The stirring keeps the melt substantially uniform in composition throughout its extent.

In FIG. 1 the removable lid which closes air-tightly over the top of the crucible, is shown at 14 with a pipe 15 opening through the center of the lid into the space S. This pipe 15 can be used for evacuation and then filling the space S with the protective gas. The previously mentioned hopper is shown at 16 in FIG. 1, and the rotary vane-type feeder is here shown at 17.

In operation, when using the improvement of this invention, a melt of cast iron of suitable composition is tapped or poured into the charging opening 10*a* of the furnace so as to partly fill the crucible S and leave the space S. This space is evacuated via the pipe 15 and then through this same pipe is filled with protective gas which is non-reactive with respect to magnesium. If the melt initially contained magnesium, as in the case of a nodular iron melt, this space S fills with magnesium vapor until the partial pressure of the vapor balances with the liquid magnesium in the melt. The loss in liquid magnesium from the melt may not be great, but it increases whenever the furnace is tapped to deliver more or less of the melt so that the space S increases in volume. The partial pressure of the vapor in the space S and the liquid magnesium content of the melt are interdependent and therefore the measuring element 7 promptly indicates this loss, informs the transducer 6 which then by operating the feeder 2 feeds magnesium or magnesium-containing particles into the space S until the space pressure indicates that the liquid magnesium content of the melt is returned to its previous value.

If, in addition, the magnesium content of the melt charged into the furnace was less than desired, the invention operates to bring the melt to the magnesium content desired.

The action is one of driving the magnesium from the space S down into the melt. The partial pressure of the magnesium vapor in the space S required for any liquid magnesium content in the melt, can be calculated with reasonable certainty, and this pressure used for the predetermined pressure maintained by the illustrated equipment modification of the furnace. Also, the transducer 6, the pressure-responsive element 7, and the feeding hopper and rotary vane feeder are all items that can be obtained commercially or engineered by any person of skill in the art.

Although not illustrated, a chamber outside of the furnace can be connected to the space above the melt by a pipe which carries the atmosphere from the space to the chamber where the magnesium vapor is condensed, permitting the magnesium in the atmosphere to be determined.

I claim:

1. A furnace for making and/or storing a molten magnesium-containing nodular iron melt, said furnace comprising an enclosure adapted to be partially filled with a molten iron melt at a temperature above the vaporizing temperature of magnesium and to enclose a space above the melt so that the space is heated by the melt to a temperature above said vaporizing temperature, said space being adapted to confine a gas that is non-reactive with magnesium, controllable feeding means for feeding magnesium or magnesium-containing particles into said space without substantial escape of pressure from the space, and means responsive to pressure in said space for automatically controlling said feeding means so as to maintain said pressure at a predeterminable value by vaporization of said particles in said space, said furnace having heating means for adding heat to said melt while in said enclosure.

2. The furnace of claim 1 in which said enclosure has a melt inlet conduit extending from above the melt level in the enclosure downwardly to and inwardly through a side of the enclosure adjacent to the enclosure's bottom, and the enclosure has a melt outlet conduit opening from the opposite side of the enclosure adjacent to its bottom and extending upwardly to above said melt level so the melt can be tapped by tilting the furnace, said heating means being a channel-type inductor in the bottom of the enclosure, and said feeding means feeding downwardly through the top wall of the enclosure.

3. A method for making and/or storing molten magnesium containing nodular iron maintained at a casting temperature above the vaporizing temperature of magnesium, in a furnace forming an enclosed space above the iron confining a gas non-reactive with the manesium and vaporized magnesium, the space being heated by the melt to a temperature above said vaporizing temperature, said method comprising measuring the pressure in said space and feeding magnesium or magnesium-containing particles into said space so as to provide a predetermined pressure in the space.

* * * * *